US005420005A

United States Patent [19]

Saitou

[11] Patent Number: 5,420,005

[45] Date of Patent: May 30, 1995

[54] SILVER HALIDE EMULSION

[75] Inventor: Mitsuo Saitou, Minami Ashigara, Japan

[73] Assignee: Fuji Photo Film Co., Ltd., Kanagawa, Japan

[21] Appl. No.: 248,541

[22] Filed: May 24, 1994

Related U.S. Application Data

[63] Continuation of Ser. No. 41,312, Mar. 31, 1993, abandoned.

[51] Int. Cl.[6] ..... G03C 1/035; G03C 1/09

[52] U.S. Cl. ..... 430/567; 430/599

[58] Field of Search ..... 430/567, 569, 599

[56] References Cited

PUBLICATIONS

Markocki, W. and Zaleski, A. Photographic Sci. Eng., 17:289 (1973).

*Primary Examiner*—Janet C. Baxter

*Attorney, Agent, or Firm*—Sughrue, Mion, Zinn, Macpeak & Seas

[57] ABSTRACT

A silver halide emulsion at least containing a dispersion medium and silver halide grains, in which the grains of 20% or more of the total projected areas of all the silver halide grains are substantially octahedral grains as derived from cubic grains by deleting substantially two diagonal apexes of the eight apices of the cubic grain, the outer surface of the deleted site is a {111} plane, and the main plane (the maximum flat plane of the outer surface of the grain) is a {100} plane. Since the sites of forming chemically-sensitized nuclei are defined in the emulsion grains, dispersion of latent images formed is inhibited. The emulsion has a high sensitivity and has excellent reciprocity law failure characteristics, developability and formed image quality.

8 Claims, 2 Drawing Sheets

SILVER HALIDE EMULSION

This is a continuation of application No. 08/041,312 filed Mar. 31, 1993, now abandoned.

FIELD OF THE INVENTION

The present invention relates to a silver halide (AgX) emulsion which is useful in the field of-photography and, in particular, to an AgX emulsion containing AgX grains of novel shapes.

BACKGROUND OF THE INVENTION

In order to elevate the photographic sensitivity of AgX emulsions, limitation of the number of chemically-sensitized nuclei (/cm$^2$) to be formed per AgX grain as well as that of the sites of the same is desired. This is because if the photoelectrons which are produced in AgX grains form latent images in many chemical-sensitized nuclei in a single AgX grain, the latent image is dispersed and therefore the sensitivity of the emulsion is not high. Accordingly, for example, a method of using normal crystalline tetradecahedral AgX grains to form chemical-sensitized nuclei preferentially on the surface of {111} plane or {100} plane of the grain is known. For instance, heretofore (1) a method of preferentially forming chemically-sensitized nuclei on a single crystal plane of an AgX grain, utilizing the difference in the reactivity of a sulfur sensitizing agent to these different crystal planes of the grain, and (2) a method of adding an adsorbent (plane-selective adsorbent) which preferentially adsorbs onto one crystal plane of these different crystal planes to form a crystal plane (hereinafter referred to as "B plane") to which the adsorbent has adsorbed more densely and a crystal plane (hereinafter referred to as "A plane") to which the adsorbent has adsorbed more sparsely, which is then followed by adding a chemical sensitizing agent thereto for chemical sensitization to thereby form chemically-sensitized nuclei preferentially on the A plane to which the adsorbent has adsorbed more sparsely are known. These methods are described in European Patent 302528A2; *Journal of Photographic Science,* Vol. 23, pages 249 to 256 (1975); JP-A 64-74540, 58-113928, 64-62631, 64-40938 (the term "JP-A" as used herein means an "unexamined published Japanese patent application"); *Journal of Japan Photographic Society,* Vol. 47, page 255 (1984), FIG. 3; and JP-A 2-146033, 2-34, 1-158425.

However, since such tetradecahedral grains have equivalent eight {111} planes and six {110} planes on the surface of a single grain, it is not sufficient to limit the sites for forming chemically-sensitized nuclei. Therefore, the number of sites for forming chemically-sensitized nuclei on the grain is limited less than is desired. Development of AgX emulsion grains with inhibited or retarded latent image dispersion is desired.

SUMMARY OF THE INVENTION

An object of the present invention is to provide an AgX emulsion containing AgX grains which are free from dispersed latent images formed therein and which have high sensitivity and good photographic properties for attaining high image quality.

The object of the present invention is attained by a silver halide emulsion at least containing a dispersion medium as a binder and silver halide grains, wherein the grains of 20% or more of the total projected areas of the silver halide grains are substantially octahedral grains derived from cubic grains by deleting substantially two diagonal apices of the eight apices of the cubic grain, that the outer surface of the deleted site is a {111} plane and that the main plane, that is the maximum flat plane of the outer surface of the grain, is a {100} plane.

Preferred embodiments of the present invention are as follows:

1. In the silver halide emulsion, the length of the edge (x) of the deleted site of the grain is from 0.06 to 0.65 of the length of the one edge (y) of the cubic grain, and the length of the edge (z) of the deleted site, if any, of the other apices satisfies the relationship $2z<x$.

2. In the silver halide emulsion, the length of the edge (x) of the deleted site of the grain is from 0.06 to 0.6 of the length of the one edge (y) of the cubic grain, and the length of the edge (z) of the deleted site, if any, of the other apices satisfies the relationship $3z<x$.

3. In the silver halide emulsion, the octahedral grains account for 50% or more of the total projected areas of all of the silver halide grains.

4. In the silver halide emulsion, the halogen composition of the {100} surface layer is substantially different from that of the {111} surface layer in the silver halide grain.

5. In the silver halide emulsion, the halogen composition of the {100} surface layer is substantially the same as that of the {111} surface layer in the silver halide grain.

6. In the silver halide emulsion, the chemically-sensitized nuclei formed in the silver halide grains are formed preferentially on the {111} plane of the grain.

7. In the silver halide emulsion, the silver halide grains have a mono-dispersed grain size distribution.

Figure 1A:
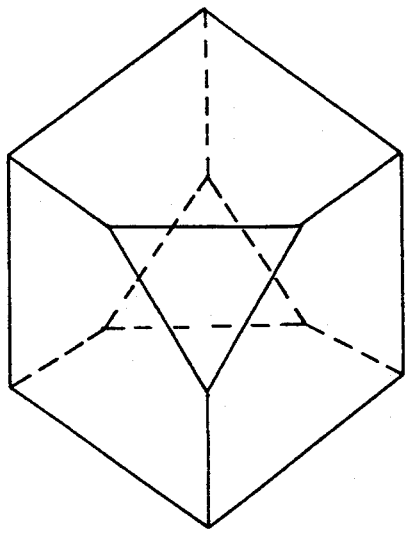
FIG. 1 shows the shape of the AgX grains of the first embodiment of the invention, in which (a) indicates a perspective view of the grain and (b) indicates an upper front view of the grain.

In the drawings, x is the length of the deleted site on one edge of the illustrated cubic grain; y is the length of one edge of the cubic grain; z is the length of the deleted site on one edge of the cubic grain; 1 is a host grain part; and 2 is a laminated part as selectively laminated on the {111} plane of the illustrated AgX grain.

DETAILED DESCRIPTION OF THE INVENTION

The AgX grains of the present invention are explained in detail hereunder with respect to the structure thereof; and methods of preparing them will also be described below in detail.

Figure 1B:
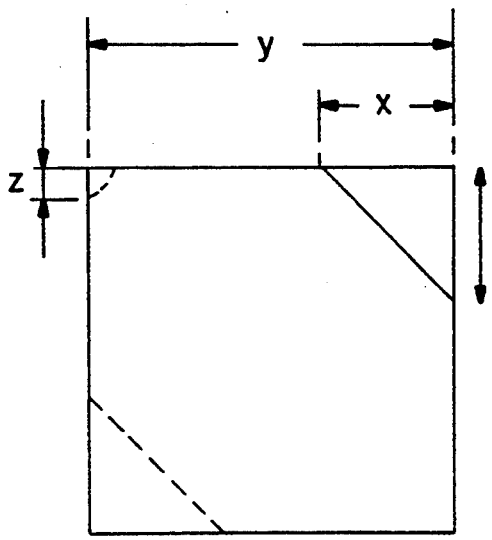

(A) Structure of AgX Grains:

The shape of the AgX grains of the present invention is shown in FIG. 1(*a*) as a perspective representation. Specifically, the shape of the grains is substantially an octahedron derived from a cube by deleting two diagonal apices of the eight apices of the cube. The shape of the crystal surface of the deleted site is a triangle, and the two triangles are parallel to each other. The surface of the triangular site is a {111} plane. This is because, since two regular triangular pyramids have been deleted from a cube, the deleted sites each are naturally a {111} plane in the NaCl type crystalline structure. The upper front view of the grain where the {100} plane has been oriented on the substrate is shown by FIG. 1(*b*).

The situation of the deleted site is explained by reference to FIG. 1(*b*), in which x/y is from 0.06 to 0.65, preferably from 0.06 to 0.6, more preferably from 0.08 to 0.5, most preferably from 0.1 to 0.4. In this case, the relationship of [area of one {100} plane of the grain $(y^2-x^2/2)$>area of one triangle of the grain $(0.866x^2)$] is satisfied. Accordingly, the largest crystal plane (main flat plane) of the grain is the {100} plane. The other six spices of the cubic grain are not substantially deleted. The wording "not substantially deleted" as referred to herein means $2z<x$, preferably $3z<x$, more preferably $5z<x$, in FIG. 1(*b*). In FIG. 1(*b*), z is a length of one side of the deleted site, if any, of the cube.

The AgX emulsion of the present invention contains the particular AgX grains with the structure described above in a proportion of 20% or more, preferably 50% or more, more preferably 80% or more, most preferably 90% or more, of the total projected area of all of the AgX grains in the emulsion.

The AgX emulsion grains of the present invention each have parallel twin crystal planes in the inside of the grain, in view of the step of producing them. The number of parallel twin planes is two or more. It is more preferred that the proportion of the grains having two parallel twin planes therein is 60% or more, more preferably 80% or more, most preferably 90% or more, of the total projected area of all the particular AgX grains having the defined shape.

The grain size of the AgX grains of the present invention is from 0.2 to 10 μm, preferably from 0.25 to 5 μm, as a diameter corresponding to the projected circle. The projected circle-corresponding diameter as referred to herein indicates the diameter of a circle having the same area as the projected area of the grain, when the grains are observed with an electronic microscope.

The grain size distribution of the AgX grains is preferably monodispersed, with a coefficient of variation of 30% or less, more preferably 20% or less, most preferably 10% or less.

The grains in the first embodiment of the present invention have the above-mentioned characteristics, in which the halogen composition of the {100} surface layer is substantially the same as that of the {111} surface layer. The term "substantially the same" as referred to herein means that the difference in the iodide content between them is less than 2 mol % and that the difference (X) in the chloride or bromide content between them is less than 7 mol % (X<7 mol %).

The second embodiment of the present invention is such that the halogen composition of the {100} surface layer of the AgX grains is substantially different from that of the {111} surface layer. The term "substantially different" as referred to herein means that the difference in the iodide content between the two surface layers is 2 mol % or more, preferably from 3 to 40 mol %, more preferably from 5 to 30 mol %, or that the difference (X) in the chloride or bromide content between them is 7 mol % or more, preferably 10 mol % or more.

The grains of the second embodiment are grouped into the following two embodiments (1) and (2).

(1) One embodiment is such that the iodide content in the {111} surface layer is lower than that in the {100} surface layer and/or the chloride content in the {111} surface layer is higher than that in the {100} layer.

In this case, it is preferred that the iodide content in the {111} surface layer is 7 mol % or less, more preferably 5 mol % or less, (2) Another embodiment is such that the iodide content in the {111} surface layer is higher than that in the {100} surface layer and/or the chloride content in the {111} surface layer is lower than that in the {100} surface layer.

Figure 2:
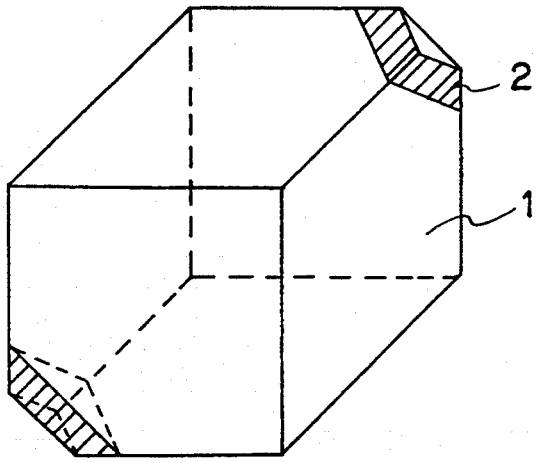
FIG. 2 shows the shape of the AgX grains of the second embodiment of the invention.

The surface layer as referred to herein indicates the crystal layer of two lattices or more, preferably five lattices or more from the grain surface. Needless to say, the preceding difference may extend the layer to a larger thickness than the defined one. For example, in FIG. 2, the thickness of the different AgX composition layer as laminated on the {111} plane is composed of two lattices or more, preferably five lattices or more, more preferably from 10 to 400 lattices.

The second embodiment of the present invention may be achieved by laminating an AgX layer having a halogen composition different from that of the host grain, on the {111} plane of the host grain having the shape of FIG. 1. The variation in the halogen composition in the interface between the host part and the laminated layer part may be any of a gradually increasing type, a gradually decreasing type and a steeply varying type, which may suitably be selected in accordance with the use and object desired. The larger the variation in the halogen composition, the greater is the introduction of crystal defects such as dislocation or the like into the part of the interface so as to advantageously accelerate formation of latent images near the defects.

This type of host grains includes uniform composition grains, core/shell two-layered grains in which the halogen composition of the core is different from that of the shell, and core/shell multi-layer grains composed of a core and two or more shell layers. The variation of the halogen composition at the interface between the layers may be any of a gradually increasing type, a gradually decreasing type and a steeply varying type, which may appropriately be selected in accordance with the use and object desired.

The mean halogen composition of the all grains of the emulsion of the present invention may be any of AgCl, AgBr and AgBrI (within the solid solution limit) and may also comprise mixed crystals of two or more of them within the a solid solution limit.

The term "within the solid solution limit" means that the iodide content of the grain does not exceed the maximum iodide content wherein the silver halide can be present in the form of solid solution while retaining its NaCl type crystalline structure. The solid solution limit depends on the precipitation temperature of the grain. For example, the solide solution limit (I'(max %)) of AgBrI is given by the following equation:

$$I'(max\ \%)=31.2+0.165(t-25)$$

wherein t is the precipitation temperature of the grain.

Where the AgX grains of the invention are applied to a negative photographic material or a color reversal photographic material of either a coupler-in-developer type or a coupler-in-emulsion type system, it is preferred for chemically-sensitized nuclei to be preferentially formed on the {111} plane of the grains. The term "preferentially" as referred to herein means that the ratio (Y) of the density of the chemically-sensitized nuclei on the {111} plane of the grain (number of chemically-sensitized nuclei/cm$^2$) to the density of the chemically-sensitized nuclei on the {100} plane of the grain (number of chemically-sensitized nuclei/cm$^2$) is preferably 2 or more, more preferably 3 or more, most preferably 5 or more.

It is difficult to directly inspect and determine the ratio. However, it is possible to obtain the ratio of the chemically-sensitized nuclei by a method of exposing the AgX emulsion-coated material for one second to form latent images on the chemically-sensitized nuclei (exposed nuclei) followed by subjecting the exposed material to restrained development so as to form restrainedly developed nuclei visible and observable with an electronic microscope and counting the number of restrainedly developed nuclei. The amount of one-second exposure is from the amount of exposure producing a density of (maximum density−minimum density)×½ to be obtained by developing the exposed area with a developer MAA-1 at 20° C. for 10 minutes to the amount of exposure 10 times larger than the former amount. The technical method for obtaining the ratio is described in D.C. Birch et al., *Journal of Photographic Science,* Vol. 23, pp. 249 to 256 (1975) and in JP-A 64-62631. The chemically-sensitized nuclei as referred to herein are those chemically sensitized with anyone of sulfur compounds, selenium compounds, tellurium compounds, gold compounds and compounds of noble metals of the Group VIII of the Periodic Table or with combinations of such compounds. Most preferred are gold-sulfur-sensitized and/or selenium or tellurium-sensitized nuclei. Details of such are described in the literatures mentioned below. The inside and/or the surface of these host grains are/is sensitized by reduction sensitization.

Where the AgX grains are used for pre-fogged direct reversal photography, it is preferred for the fogged nuclei to be formed preferentially on the {111} plane of the grain. The term "preferentially" as referred to herein indicates that the ratio of the density of the fogged nuclei on the {111} plane of the grain (number of fogged nuclei/cm$^2$) to the density of the fogged nuclei on the {100} plane of the grain (number of fogged nuclei/cm$^2$) is preferably 2 or more, more preferably 3 or more, most preferably 5 or more. It is difficult to directly determine the ratio. However, it is possible to obtain the ratio of the fogged nuclei by developing the AgX emulsion-coated material by restrained development followed by inspecting and determining the restrainedly developed nuclei by the preceding method. In the case of such pre-fogged grains, it is preferred for the inside and/or the surface of the host grain not sensitized by reduction sensitization.

Of these grains, preferred grains are those of the embodiment where sensitizing dyes are adsorbed preferentially on the {100} plane of the grain. The term "preferentially" means that the ratio of the density of the adsorbed dyes on the {100} plane (number of adsorbed dye molecules/cm$^2$) to the density of the adsorbed dyes on the {111} plane (number of adsorbed dye molecules/cm$^2$) is preferably 2 or more, more preferably 3 or more, most preferably 5 or more.

In the second embodiment, the preceding embodiment (1) is more preferred. This is because latent images are formed on the laminate part in the embodiment (1) so that the development rate is promoted to a greater extent.

(B) Method of Preparation of AgX Emulsion

The method of preparing the AgX emulsion of the present invention basically comprises forming tabular seed crystals, growing the crystals and chemically sensitizing them. These steps are explained in detail hereunder.

(1) Forming Tabular Seed Crystals

For preparing the AgX grains of the present invention, tabular grains each having parallel twin planes are formed first, and these are used as seed crystals. As a method of conventional AgBrI tabular grains (in which the iodide I- content is from 0 mol % to the solid solution limit), the descriptions in JP-A 58-113926 through 58-113928 can be referred to. On the other hand, as a method of forming well mono-dispersed parallel double twin plane tabular grains, the descriptions of JP-A 63-11928, 63- 151618, 1-131541, 2-838, 2-28638 and 3-163433, and European Patents 514742A and 514743A can be referred to.

For the latter, briefly, the grains are formed by a process comprising nuclei formation and ripening of the nuclei. An aqueous silver salt solution and an aqueous solution of halide(s) (hereinafter referred to as X-salts) are added to an aqueous solution containing a dispersion medium as a binder at pBr of 2.5 or less, preferably from 1 to 2.5 to form nuclei. The frequency of forming twin planes during the step of forming nuclei depends upon various supersaturating factors (such as the gelatin concentration during the formation of nuclei, the molecular weight of the gelatin used, the speed of adding the aqueous silver salt solution and the aqueous solution of halide(s), the Br−, I− and Cl− concentrations in the reaction system, the rate of stirring rotation, the I-content n the aqueous halide solution to be used, the concentration of the AgX solvent used, the concentration of non-related salts, the period of forming nuclei, pH); and a part of the relationships is shown in the drawings of JP-A 63-92942. If the probability of formation of twin planes is elevated too greatly, the ratio of the presence of triple-layered or more multi-layered twin plane grains or non-parallel double-layered twin plane grains in the ripened seed crystals would be too high. Therefore, considering the relationships shown in these drawings, the supersaturating factors are controlled to be not too high but not too low in order that the ratio of parallel double-layered twin plane grains in the seed-crystals may be high.

The period of time of forming nuclei is preferably 6 minutes or less, more preferably 3 minutes or less, most preferably one minute or less.

After formation of nuclei in this way, the nuclei formed are then subjected to first ripening at a pBr of 2.0 or less, preferably from 1 to 1.7 and at a temperature of 50° C. or higher, preferably 60° C. or higher. According to this, non-tabular grain nuclei as formed in the step of forming nuclei are removed. After the first ripening, they may be put to the next crystal growing step. More preferably, the nuclei are, after the first ripening, subjected to a second ripening prior to the next crystal growing step whereby non-tabular grains are removed more completely. For effecting the second ripening, an $AgNO_3$ solution is added to the first-ripened nuclei, whereupon the pBr of the ripening system is increased to 0.1 or more, preferably 0.3 or more, and the nuclei are further ripened preferably at a pBr of 1.7 or more, more preferably from 1.8 to 3. During the ripening, especially during the second ripening, an AgX solvent may be added to the ripening system. Suitable AgX solvents are described hereinafter. The amount of the AgX solvent used may be from 0 to 0.3 mol/liter, preferably from $10^{-4}$ to 0.3 mol/liter.

The higher the pBr value is during the second ripening step or the higher the AgX solvent concentration is in this step, the greater the thickness of the tabular grains formed and the lower is the aspect ratio (diameter/thickness of the projected grain) of the grains. Accordingly, seed crystals each having parallel twin planes are formed. During or after the second ripening, a third ripening step may be employed for forming the grains of the present invention by selecting an optimum pBr value of 2.1 or more, preferably 2.3 or more, using a so-called try-and-error method by observation and inspection of the shape of the grains being formed. The optimum value depends upon the halogen composition of the grains being formed, the kind and concentration of AgX solvent being used, and the grain size of the grains being formed. The higher the pBr value or the higher the AgX solvent concentration, the more completely cubic is the shape of the grains formed. However, in many cases, the nuclei formed are directly subjected to the next step of crystal growing.

(2) Growing Crystals

After the seed crystals each having parallel twin planes have been formed in the manner described above, they are subsequently grown by using of the following steps.

(i) The seed crystals are grown in the region forming cubic or tetradecahedral grains. More specifically, in the case of AgBr, the optimum pBr value of 2.1 or more, preferably 2.3 or more, for forming such grains may be selected by the so-called try-and-error method with observing the shape of the growing grains. The optimum value depends upon the halogen composition of the growing grains, the kind and concentration of AgX solvent being used, the degree of supersaturation during growth of the grains and the grain size of the growing grains. The higher the pBr value or the higher the AgX solvent concentration, the more completely cubic is the shape of the growing grains.

(ii) After the seed crystals are grown at a pBr of less than 2.1, they are further grown at a selected optimum pBr value of 2.1 or more, preferably 2.3 or more. The same as in the preceding step (i) applies to the selection of the optimum pBr value.

In these cases, where the halogen composition of the seed crystal part is same as that in the growing part, uniform composition host grains are obtained. On the other hand, where the seed crystal part is different from the growing part at least in terms of the halogen composition, core/shell double-layer structure grains or multilayer structure grains may be obtained.

During the growing step, where lamination of an AgX layer containing Cl− is desired, the excess halogen ion in the reaction solution is Cl−. For this, excess Br− is reduced by washing the emulsion with water or by adding $AgNO_3$ to the emulsion so that Br− in the emulsion is reduced and a Cl− salt is added. Then, a silver salt solution and an X− salt solution are added to the emulsion.

(iii) After the seed crystals are grown at a pBr of less than 2.1, the crystals are further ripened at a selected optimum pBr value of 2.1 or more, preferably 2.3 or more to obtain the grains of the present invention. The same as above applies to the selection of the optimum pBr value.

For forming the grains of the second embodiment of the present invention, an AgX layer of a different halogen composition may be selectively laminated on the {111} surface of the thus formed grains having the shape as shown in FIG. 1.

The plane-selective crystal growth may be effected by controlling the supersaturation S and pAg of the reaction solution for growing the crystals. Where the chemical potentials of Ag+ on the {100} plane and the {111} plane are $\mu 100$ and $\mu 111$, respectively, and the chemical potential of Ag+ in the solution to which a silver salt and an X− salt are being added is $\mu Ag+$; then the silver salt and X- are added to the system under the condition of S and a pAg satisfying $\mu 100 > \mu Ag+ > \mu 111$, more preferably $\mu 100 >> \mu Ag+ > 111$, whereby the intended object is attained. $\mu Ag+$ and S are characterized by a relation of $\mu Ag+ = kTlnS$ (in which k is a Boltzmann constant and T is absolute temperature). The condition of $\mu 100 > \mu 111$ may be attained by controlling the emulsion conditions to be these described above for forming cubic grains. For instance, where tetradecahedral grains are in a solution having a pAg value in the region of forming cubic grains, then $\mu 100 > \mu 111$.

In this case, the supersaturated concentration during the growth of the grains must be controlled accurately. For this, a method of adding a previously prepared ultra-fine grain emulsion having a grain size (diameter) of 0.1 μm or less of, for example, AgCl, AgBr, AgI and/or mixed grains of them is effective. As such ultra-fine grains, more preferred are those free from twin planes and from dislocation. In this step, the supersaturated concentration is controlled accurately to be the solubility of the ultra-fine grains. The details of this method are described in JP-A 4-34544, 2-146033 and 2-166442.

For forming the surface layer having a different halogen composition, interlayer or intergranular Ostwald ripening is not preferred. Therefore, the temperature for the step is desired to be low, preferably 70° C. or lower, more preferably from 30° C. to 60° C.

After the growth of the crystals, an adsorbent which is described below is immediately adsorbed thereto so as to preferably prevent interlayer Ostwald ripening.

Other grains which are suitable for the present invention include those obtained by further growing the laminate part of the grain of the second embodiment, the thus grown grains satisfying the condition of $0.01 < x/y < 0.05$, preferably $0.02 < x/y < 0.05$. These are such that the deleted parts have been filled almost completely with an AgX layer having a halogen composition different from that of the host grain. However, after the deleted parts have been filled in the way, the added solute is then laminated on the {100} plane. Therefore, addition of the solute is preferably stopped before the deleted parts are filled with the layer. More preferred are the preceding grains.

The descriptions in JP-A 2-32, 63-281149, 63-218938, 64-72142, 58-111936; *Journal of Imaging Science,* Vol. 34, pp. 44–50 (1990); ibid., Vol. 33, pp. 13–17 (1989); and Journal of Photographic Science, Vol. 36, pp. 182–186 (1988) are suitable for formation of tabular grains having a high chloride (Cl−) content and having parallel twin planes.

Basically, these tabular grains may be selectively formed using the same method as that of forming the preceding AgBrI tabular grains, which comprises formation of nuclei followed by ripening of the nuclei formed.

Where an AgX layer having a high chloride (Cl−) content is desired to be laminated successively on the high-chloride tabular seed crystals formed in the manner mentioned above, a part or all of the crystal habit controlling agent present in the reaction system forming the seed crystals is removed. The greater the extent of removal, the more the variation of the grain growing atmosphere to the direction of forming tabular grains, octahedral grains, tetradecahedral grains and cubic grains in this order. Accordingly, the relationship between the percentage of the removal and the shape of the final grains is determined by the so-called try-and-error method, and the optimum percentage for the removal thus obtained may be employed. The percentage for removal is generally 50% or more, more preferably from 75 to 97%. Suitable means for removal include, for example, an emulsion washing method, an adsorbing and removing method using a solid adsorbent, a centrifugal washing method, and an adsorbing and removing method by controlling the pH and pAg values of the reaction system. For the details of the methods, referred to are the descriptions of JP-A 1-201651, 4-308840, 62-240951 and Japanese Patent Application No. Hei 3-140712. Grains having a high chloride (Cl−) content as referred to herein indicate those having a chloride content of 50 mol % or more. The chloride concentration in the reaction system during growth of the grains is preferably 5 mol/liter or less, more preferably from 0.01 to 1 mol/liter.

The temperature and pH conditions for the growth of the grains are not specifically defined. In general, the temperature is preferably 25° C. or higher, more preferably from 30° to 80° C.; and the pH preferably is 8 or less, more preferably from 2 to 7. Combinations of the most preferred temperature, pH and pAg values may be selected for the process.

(3) Chemical Sensitization

The AgX emulsion of the present invention may be chemically sensitized using any conventional method. Preferential formation of chemically-sensitized nuclei on the surface of the {111} plane of the AgX grain or on the surface of the laminate part of the grains is preferred. The method of chemical sensitization is described in European Patent 302528A2; JP-A 64-74540, 64-62631, 64-40938, 2-34, 1-158425, 1-201651, 2-146033, 2-838, 2-28638, 2-298935; Japanese Patent Application Nos. Hei 3-115872, 3-73266, 3-285488; and *Journal of Photographic Science,* Vol. 23, pp. 249–256 (1975).

Briefly, the following methods can be advantageously employed:

① A chalcogen sensitizer such as a hypo, which is more selectively reactive to the surface of the {111} plane of the AgX grain than to the surface of the {100} plane of the AgX grain is reacted with the grains. As a result of this reaction, emulsion grains of the present invention having chalcogen-sensitized nuclei preferentially on the {111} plane are obtained.

② Next, a gold sensitizer is added to the emulsion to form gold-chalcogenide-sensitized nuclei on the grains by ripening, whereupon the amount of the remaining non-reacted chalcogen sensitizer is preferably small. This is because if the amount is large, preferential orientation is often low. Specifically, (i) the gold sensitizer is added preferably after 70% or more, more preferably 85% or more, of the added chalcogen sensitizer has been reacted; or (ii) it is added after the non-reacted chalcogen sensitizer has been removed. More specifically, suitable methods include a method of removing the remaining non-reacted chalcogen sensitizer by washing the emulsion with water or of adding to the emulsion an additive which reacts with the remaining nonreacted chalcogen sensitizer to make it inactive, for example, adding $HNO_3$ or the like to lower the pH of the emulsion and/or adding an oxidizing agent; a method of removing the non-reacted chalcogen sensitizer with an adsorbent (e.g., active charcoal, ion-exchanging resins, chelating agents); a method of centrifuging the emulsion to remove the resulting supernatant so as to remove 40% or more, preferably from 70 to 90%, of the dispersion medium; and combination of two or more of the methods. According to the methods, the ratio of the amount of the remaining non-reacted chalcogen sensitizer to the amount of chalcogen sensitizer added is reduced to 0.3 or less, more preferably 0.15 or less. When the pH of the emulsion is reduced so as to make the remaining non-reacted chalcogen inactive, then the reduced pH value is again elevated to the original pH after the step. When an oxidizing agent is used, the necessary amount of oxidiying agent may be added to the emulsion. Suitable oxidizing agents are $H_2O_2$, oxygen acids, peroxides, and metal or non-metal oxides. The adsorbents which can be used for the purpose, are described in Japanese Patent Application No. Hei 3-73266.

③ After an adsorbent capable of preferentially adsorbing to the {100} plane of the Agx grain has been added to the emulsion, a chemical sensitizer is added thereto to form chemically-sensitized nuclei preferentially on the {111} plane of the grain. In this case, the combination of the preceding methods ① and ② is preferred as the preferential orientation is formed to a greater extent.

④ For forming grains of the second embodiment of the invention, the site of forming chemically-sensitized nuclei is defined further by utilizing the difference in the halogen composition between the host part and the laminate surface part in addition to the difference in the crystal habit therebetween. Precisely, an adsorbent is preferentially adsorbed onto the surface of the host part and thereafter the grains are chemically sensitized to form the chemically-sensitized nuclei preferentially on the surface of the laminate part. The term "preferential adsorption" as referred to herein means that the number of the molecules of the adsorbent as adsorbed on the {100} plane of the host grain (per $cm^2$) to the number of the molecules of the adsorbent as adsorbed on the laminate part of the grain (per $cm^2$) is preferably 2 or more, more preferably 3 or more, most preferably from 5 to 15. Adsorption of the adsorbent also to the {111} plane of the AgX grain is possible so as to define the number of chemically-sensitized nuclei (per $cm^2$) on the {111} plane of the grain.

The adsorbent to be used in these cases may be selected from sensitizing dyes, antifoggants, dimer or higher polymers of these compounds and pendant dyes (e.g., as described in European Patent 372 573 A2). Two or more different adsorbents may be used in combination if desired.

Examples of dyes more selectively adsorbable to the {100} plane of the AgX grains of the present invention than the {111} plane of the AgX grains are as follows:

(E-1) 3,3'-bis(4-Sulfobutyl)-9-methyl-thiacarbocyanine pyrrolidium salt (E-2) 5,5'-Diphenyl-9-ethyl-3,3'-di(2-sulfoethyl)-oxacarbocyanine sodium salt (E-3) 5-Chloro-5=-phenyl-9-ethyl-3-(3-sulfopropyl)-3'-(2-sulfoethyl)oxacarbocyanine sodium salt (E-4) 5,5'-Dichloro-9-ethyl-3,3'-di(3-sulfopropyl)oxacarbocyanine sodium salt (E-5) 5,5'-Dichloro-6,6'-dichloro-1,1'-diethyl-3,3'-di(3-sulfopropyl)imidacarbocyanine sodium salt (E-6) 5,5'-Diphenyl-9-ethyl-3,3'-di (3-sulfopropyl)-thiacarbocyanine sodium salt It is known that the adsorbing power of these sensitizing dyes and antifoggants to AgX grains depends upon the crystal habit and halogen composition of the substrate and also upon other various characteristics of the emulsion (e.g., pH and pAg of the emulsion and presence or absence of an adsorbing aid in the emulsion). Therefore, utilizing known knowledge, the adsorbing intensity of the sensitizing dyes and antifoggant added may well be controlled. For instance, an antifoggants is desired to be adsorbed to the grains under the pH condition of (pKa−1) or more where Ka means the acid dissociating constant of the antifoggant added. In general, the greater is the adsorbing power, the greater the sensitizing dye forms a J-aggregate form thereof. The J-aggregate form of a sensitizing dye is preferred because it inhibits formation of chemically-sensitized nuclei more sufficiently.

The amount of adsorbent used for the purpose preferably is from 15 to 180%, preferably from 20 to 100 of the saturated adsorption amount.

In addition, the adsorbent may also be used as a function-separated form of it, i.e., used such a manner that 10% or more of the absorbent is detached and eliminated after chemical sensitization as described in JP-A 1-201651 and Japanese Patent Application No. Hei 3-73266.

Suitable sulfur sensitizers include thioureas, thiazoles, rhodanines, inorganic sulfurs, 1-methyl-2-thiosuccimide, 3-allyl-4-oxo-oxazolidine-2-thione, sodium p-toluenethiosulfonate and the like; and examples of selenium or tellurium sensitizers are substituents of the compounds of the preceding sulfur sensitizers obtained by substituting an S-atom therein by Se or Te, as well as phosphine selenides, selenoamides and the like. These sensitizers are described in JP-A 64-40938, 64-74540, 4-25832, 4-109240, and Japanese Patent Application Nos. Hei 3-53693, 3-131598, 2-333819, 3-53693, 3-82929 and the literatures mentioned below.

The amount of sulfur sensitizer present in the phase of the AgX grain is from $10^{-9}$ to $10^{-3}$ mol/mol of AgX, preferably from $10^{-8}$ to $10^{-4}$ mol/mol of AgX.

Preferred gold sensitizers are gold complexes (such as those described in U.S. Pat. No. 2,399,083). More specifically, chloroauric acid, alkali metal chloroaurates, sodium or potassium auriothiocyanate, auric trichloride, sodium auriothiosulfate and auric-5-sulfobenzothiazole-2-sulfide chloride are suitable examples. The amount of gold sensitizer present in the phase of the AgX grain is from $10^{-9}$ to $10^{-3}$ mol/mol of AgX, preferably from $10^{-8}$ to $10^{-4}$ mol/mol of AgX.

(C) Other Matters

During or after chemical ripening of the AgX grains, different fine AgX grains (AgCl, AgBr, AgI or mixed crystals of two or more of them) having a grain size of 0.1 μm or less, which may deposit on the grains, may be added to them prior to ripening of the grains. Addition of such fine AgX grains is preferred since the chemically-sensitized nuclei may be made latent in the shallow surface of the substrate grain. Chemical ripening of the AgX grains in the presence of an $SCN^-$ salt, an S-containing compound or a ripening accelerator (AgX solvent) is also possible. These techniques are described in the literatures mentioned below.

Examples of methods of adding silver ions and X-ions to the grains during the growth of the grains include a method of adding a silver salt solution and an $X^-$ salt solution; a method of previously adding an ultra-fine grain emulsion (AgCl, AgBr, AgI and/or mixed crystals of them) having a grain size of 0.1 μm or less; or combination of the methods. Also a method of increasing the addition speed of the solutes during the growth of the grains can be employed. Further, a method of adding them through a porous substance can be used. These techniques are described in JP-A 2-146033, 3-21339, 4-34544, 3-246534 and Japanese Patent Application Nos. Hei 2-326222.

To promote ripening of the grains during the physical ripening step or to promote the growth of the grains during the crystal growing step or to promote chemical ripening of the grains, or during the formation of the nuclei of the grains, an AgX solvent may be added to the reaction system. Examples of usable AgX solvents are antifoggants such as thiocyanates, ammonia, ammonium salts, thioethers, thioureas and tetrazaindene compounds, as well as organic amine compounds. These compounds are described in the literatures mentioned below.

In accordance with the present invention, the grains may be used as cores to form a shallow latent image-forming emulsion. This type of emulsion is preferred, since the latent image formed is protected from external influence by the AgX layer and is thereby stabilized. The emulsions are described in JP-A 59-133542, 63-151613 and U.S. Pat. Nos. 3,206,313, 3,317,322.

The preceding silver halide grains may be formed in the emulsions of the present invention as they are. If desired, the grains may be formed in a core/shell direct reversal emulsion in which the grains are the cores of the core/shell grains. Emulsions of this type are disclosed in U.S. Pat. Nos. 3,761,276, 4,269,927 and 3,367,778. The core/shell direct reversal emulsion of this type may be used advantageously as a emulsion and is described in JP-A 60-95533.

Using the grains as substrate grains, ruffled grains may also be formed therefrom. U.S. Pat. No. 4,643,966 discloses these types of grains. Using the grains as cores or during formation of the grains, the formation of grains each having an internal dislocation line in the grain is also possible as described in JP-A 63-220238 and 3-163433.

In addition, epitaxial grains may also be formed, using the grains as host grains. Epitaxial grains are described in *Journal of Imaging Science,* Vol. 32, pp. 160–177 (1988) and the literatures mentioned below.

Suitable sensitizing dyes which can be used as an adsorbent and a color sensitizing dye in the present invention, are, for example, cyanine dyes, merocyanine dyes, complex cyanine dyes, complex merocyanine dyes, holopolar cyanine dyes, hemicyanine dyes, styryl dyes, hemioxonole dyes, oxonole-merostyryl and streptocyanine-containing polymethine dyes, and pendant dyes.

More preferably, in the AgX emulsion before coating, the sensitizing dye is adsorbed more preferentially to the {100} plane of the grain than the {111} plane of the same. For this, a sensitizing dye capable of preferentially adsorbing to the {100} plane of the grain is used as a color sensitizing dye. Specific examples of such dyes are described in the preceding (E-1) to (E-6). The above term "preferential adsorption" as referred to herein means that the ratio of the number of molecules of the adsorbing agent adsorbed onto the {100} plane of the host grain (per $cm^2$) to the number of molecules of the agent adsorbed onto the laminate part of the grain (per $cm^2$) is preferably 2 or more, more preferably 3 or more, most preferably from 5 to 15.

The grains may optionally be color-sensitized with antenna dyes as described in JP-A 63-138341 and 63-138342.

Examples of antifoggants which can be used as an adsorbent or antifoggant in the present invention are, for example, tetrazaindenes; azoles such as benzothiazolium salts, nitroindazoles, nitrobenzimidazoles, chlorobenzimidazoles, bromobenzimidazoles, mercaptothiazoles, mercaptobenzimidazoles, aminotriazoles, benzotriazoles, nitrobenzotriazoles and mercaptotetrazoles (especially, 1-phenyl-5-mercaptotetrazole); mercaptopyrimidines; mercaptotriazines; thioketo compounds such as oxazolithiones; as well as benzenethiosulfinic acids, benzenesulfinic acids, benzenesulfonic acid amides, hydroquinone derivatives, aminophenol derivatives, gallic acid derivatives, and ascorbic acid derivatives.

The dispersion medium for use in the present invention can be any known dispersing agent used as a binder for AgX emulsions. In general, gelatin is preferably used. More preferably, an alkali-processed gelatin from which impurity ions and impurities have been removed is used. Suitable gelatins, usable in addition to alkali-processed gelatin are an acid-processed gelatin, gelatin derivatives such as phthalated gelatin, low molecular gelatins (having a molecular weight of from 1000 to 100,000; examples of them are enzyme-decomposed gelatins, hydrolyzed gelatins hydrolyzed with acids and/or alkalis, and pyrolyzed gelatins), high molecular weight gelatins (having a molecular weight of from 100,000 to 300,000), gelatin having a methionine content of 50 μmol/g or less, an oxidized gelatin, and an inactivated gelatin where the methionine has been inactivated by alkylation or the like. Two or more of these gelatins may be used in combination of desired.

In addition, any known conventional techniques may be employed in the present invention in combination with those mentioned above. Employable techniques are disclosed in the literatures mentioned below.

Additives which can be added to the silver halide emulsion during preparation of the emulsion from formation of the grains to coating of the formed emulsion are not specifically limited. Suitable additives employable in the present invention, are, for example, a silver halide solvent (or a ripening accelerator), a doping agent for silver halide grains (compounds of noble metals of Group VIII of the Periodic Table and other metal compounds (compounds of gold, iron, lead or cadmium), chalcogen compounds, SCN-ated compounds), a dispersion medium, an antifoggant, a stabilizer, a sensitizing dye (for blue-sensitization, green-sensitization, red-sensitization, infrared-sensitization, panchromatic sensitization, orthosensitization), a super-color sensitizer, a chemical sensitizer (compounds of sulfur, selenium, tellurium, gold and noble metals of Group VIII, and phosphorus compounds. These can be used singly or combination of them. Most preferred are a chemical sensitizer comprising a combination of gold, sulfur, selenium and tellurium compounds, and a reduction sensitizer comprising stannous chloride, thiourea dioxide, polyamines and amineborane compounds). Further, a foggant (organic foggants such as hydrazine compounds, and inorganic foggants), a surfactant (defoaming agent, etc.), an emulsion precipitating agent, a soluble silver salt (AgSCN, silver phosphate, silver acetate, etc.), a latent image stabilizer, a pressure desensitization inhibitor, a hardening agent, a developing agent (hydroquinone compounds, etc.), a development modifying agent, a dye-forming agent and color photographic additives can be used. Specific examples of these materials and methods of using them are described in the literatures mentioned below.

Regarding the steps of grain formation, emulsion rinsing, chemical sensitization, color sensitization, coating, exposure and development, and also regarding the layer constitution of the AgX emulsion-coated material and the way of storing the coated material; all combinations of known techniques and known compounds as described in the literatures mentioned below are employable in the present invention.

The silver halide emulsion of the present invention may be used in preparing black-and-white silver halide photographic materials (such as X-ray photographic materials, printing photographic materials, photographic papers, negative films, micro films, direct positive photographic materials, ultra-fine grain dry sheet photographic materials (for LSI photomasking, shadow or liquid crystal masking ) ) and also color photographic materials ( such as negative films, photographic papers, reversal films, direct positive color photographic materials, silver dye bleaching photographic materials). In addition, it may also be used in preparing diffusion transfer photographic materials (such as color diffusion transfer elements, silver salt diffusion transfer elements), black-and-white and color heat-developing photographic materials, high-density digital recording photographic materials, and photographic materials for holography as described in the literature mentioned below.

Suitable literature describing techniques usable in the present invention are *Research Disclosure,* Vol. 176 (Item 17643; December, 1978); ibid., Vol. 307 (Item 307105; November, 1989); Duffin, *Photographic Emulsion Chemistry* (published by Focal Press, New York, 1966); E. J. Birr, *Stabilization of Photographic Silver Halide Emulsions* (published by Focal Press, London, 1974); T. H. James, *The Theory of the Photographic Process,* Fourth Ed. (published by Macmillan, New York, 1977); P. Glafkides, *Chimie et Physique Photographiques,* Fifth Ed. (Edition de 1', Usine Novelle, Paris, 1987); ibid , Second Ed (Paul Montel, Paris, 1957); V. L. Zelikman et al., *Making and Coating Photographic Emulsion* (Focal Press, 1964); K. R. Hollister, *Journal of Imaging Science,* Vol. 31, pp. 148–156 (1987); J. E. Maskasky, ibid., Vol. 30, pp. 247–254 (1986); ibid., Vol. 32, pp. 160–177 (1988); ibid., Vol. 33, pp. 10–13 (1989); Friezer et al., *Die Grundlagen der Photographischen Prozesse mit Silverhalogeniden* (Akademische Verlaggesellschaft, Frankfurt, 1968); *Monthly Journal of Japan Chemical Association,* December 1984, pp. 18–27; *Journal of Japan Photographic Association,* Vol. 49, pp. 7–12 (1986); ibid., Vol. 52, pp. 144–166 (1989); ibid., Vol. 52, pp. 41–48

(1989); JP-A 58-113926 to 58-113928, 59-90841, 58-111936, 62-99751, 60-143331, 60-143332, 61-14630, 62-6251, 63-220238, 63-151618, 63-281149, 59-133542, 59-45438, 62-269958, 63-305343, 59-142539, 62-253159, 62-266538, 63-107813, 64-26839, 62-157024, 62-192036, 1-297649, 2-127635, 1-158429, 2-42, 2-24643, 1-146033, 2-838, 2-28639, 3-109539, 3-200952, 4-34544, 3-246534; U.S. Pat. Nos. 4,636,461, 4,942,120, 4,269,927, 4,900,652, 4,975,354; European Patent 355568A2; and Japanese Patent Application Nos. Hei 2-326222, 2-415037, 3-160395, 3-146503.

The silver halide emulsion of the present invention is also preferably used as an emulsion for one or more layers of examples as described in European Patent 508398A1, JP-A 4-151649 and 3-226703, Japanese Patent Application No. Hei 4-179961 and U.S. Pat. No. 4,623,612.

The present invention is explained in greater detail below by way of the following examples, which, however, are not intended to limit the scope of the present invention. Unless otherwise indicated, all parts perants, ratios and the like are by weight.

EXAMPLE 1

1200 cc of a dispersion medium solution (comprising 8.4 g of gelatin having a mean molecular weight of 20,000 and 5.4 g of KBr and having pH of 5.7) was put in a reactor and kept at 30° C. To this were added an aqueous solution of Ag-1 (containing 20 g of $AgNO_3$ in 100 cc) and an aqueous solution of Br-1 (containing 14.9 g of KBr and 0.7 g of 20,000 Gel in 100 cc) each at a flow rate of 48 cc/min using a double-jet method. After stirring the mixture for one minute, 168 cc of an aqueous gelatin solution (containing 38 g of deionized alkali-processed gelatin for photographic use, pH 5.5) was added thereto. After stirring the mixture for one minute, the temperature of the reaction system was elevated to 75° C. and the contents of the reactor were ripened for 12 minutes, at these conditions. Next, 32.4 cc of the aqueous Ag-l solution was added thereto at a flow rate of 7 cc/min, and 9.5 cc of an aqueous $NH_4NO_3$ solution (50 wt. % concentration) and 9.5 cc of an aqueous $NH_3$ solution (25 wt. % concentration) were added thereto. Thus, the contents were ripened for a further 18 minutes. Next, 3 N $HNO_3$ solution was added thereto to adjust the pH of the system to 5.5.

Figure 3:
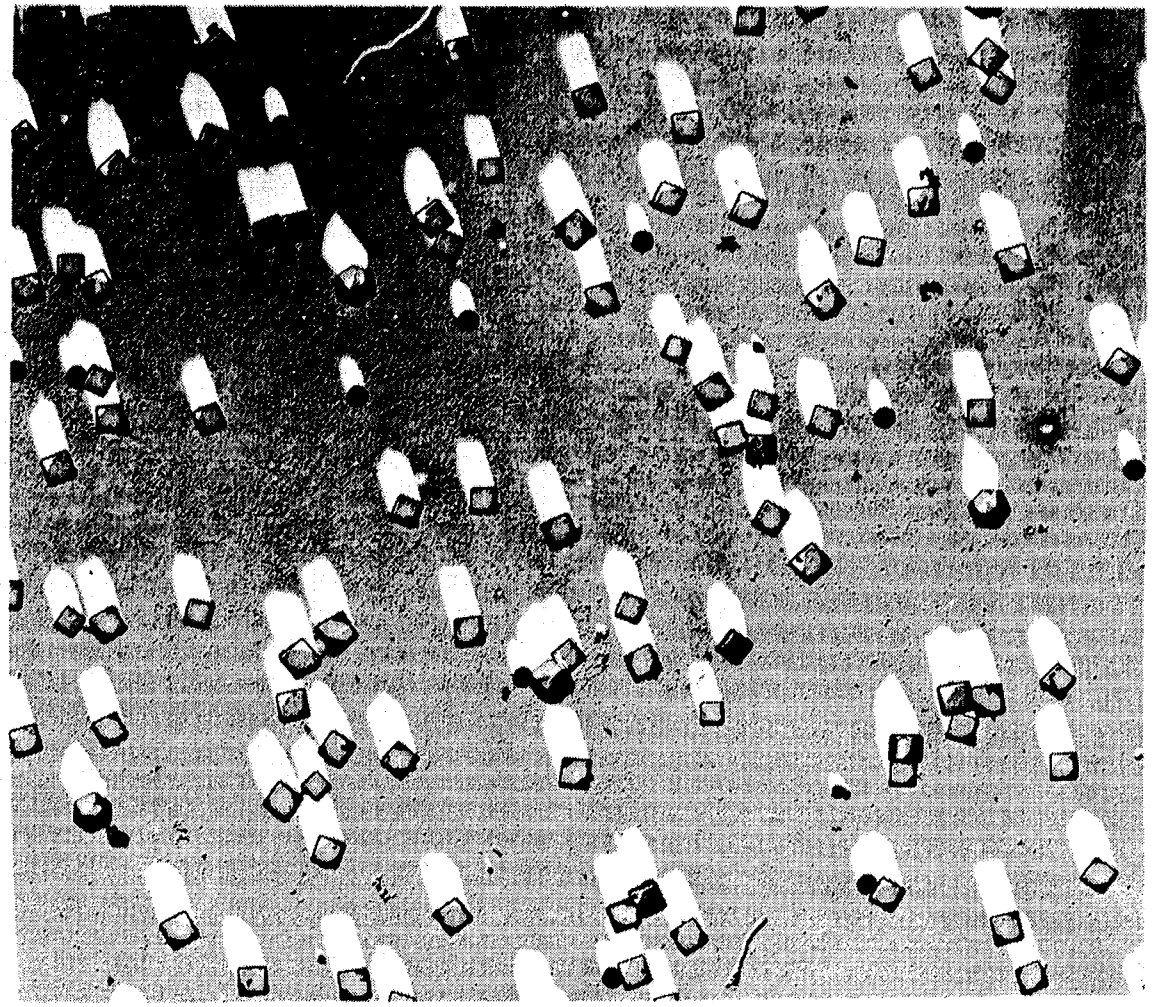
FIG. 3 is a microscopic photograph at 5000 magnification, which shows the structure of the emulsion grains of the first embodiment of the invention as produced in Example 1 hereinafter.

Next, an aqueous solution of Br-2 (containing 14.4 g of KBr in 100 cc) was added to the system to adjust the pH thereof to 1.77. The Ag-1 solution and the Br-2 solution were added thereto each at a flow rate of 10 cc/min over a period of 8 minutes using a controlled double jet method at a pBr of 1.77 (silver potential −20 mV vs. saturated calomel electrode). Next, the Ag-2 solution was added thereto, and the silver potential was changed to 100 mV. Under these conditions, the Ag-1 solution and the Br-2 solution were added thereto at this potential using a controlled double jet method, which is a linear flow rate increasing method with an initial flow rate of 13.3 cc/min and an accelerated flow rate of 0.3 cc/min, over a period of 39 minutes. After the addition, the system was stirred for 2 minutes. Then, a flocculating agent was added thereto, and the temperature was lowered, whereupon the emulsion formed was washed with water using a flocculating water-washing method. Next, the emulsion was again dispersed and adjusted to a pH of 6.4 and a pBr of 2.6. The emulsion grains as sampled under these conditions were photographed by transmission electromicroscopic (TEM) photography, and a replica of the image (TEM image) is shown in FIG. 3. From this, it can be seen that the mean value of x/y at the deleted parts of the cubic grains was about 0.37; and y=0.8 μm and z 0.05 μm.

An aqueous solution of Dye (E-1) described above was added to the emulsion in an amount of 70% of the saturated adsorption amount, the temperature thereof was elevated to 70° C., and the emulsion was ripened for 10 minutes under these conditions. Then, the temperature was lowered to 58° C., and a $Na_2S_2O_3$ solution was added to the emulsion in an amount of $7\times10^{-6}$ mol/mol of AgX and the mixture was ripened for 20 minutes. Next, a gold sensitizer (mixed solution of chloroauric acid and NaSCN) was added thereto in an amount of $5\times10^{-6}$ mol/mol of AgX and the mixture ripened for 10 minutes. Then, the temperature was lowered to 40° C., and an antifoggant TAI (4-hydroxy-6-methyl-1,3,3a,7-tetrazaindene) was added thereto in an amount of $2\times10^{-3}$ mol/mol of AgX, and a coating aid was added thereto. The emulsion thus formed was coated on a polyethylene terephthalate support film in an amount of 1.5 g/m$^2$ as silver. The coated sample was designated J1.

EXAMPLE 2

To the emulsion grains formed in Example 1 was added the Ag-2 solution (containing 10 g of $AgNO_3$). After the silver potential of the emulsion was changed to 120 mV, the Ag-1 solution and an X-2 solution (containing 13.4 g of KBr and 0.97 g of KI in 100 cc) were added thereto using a controlled double jet method at this potential wherein the Ag-1 solution was added in an amount of 150 cc at a flow rate of 18 cc/min. The emulsion grains formed were sampled and the TEM image thereof was taken. No change was found in the shape of the grains on observing the image. From this, it was noted that the AgBrI layer was uniformly laminated on the seed crystals.

Next, $NHO_3$ (3 N) solution was added to the emulsion, the pH value of the emulsion was adjusted to be 5.4, the Ag-2 solution was added thereto, the silver potential was changed to +160 mV, and then the Ag-1 solution and the Br-2 solution were added to the emulsion using a controlled double jet method at this potential wherein the Ag-1 solution was added in an amount of 22 cc at a flow rate of 10 cc/min. Immediately after the addition, Sensitizing Dye (E-3) was added to the emulsion in an amount of 70% of the saturated adsorption amount. The emulsion grains formed were sampled and the TEM image thereof was taken. It was found on observing the image that the added AgBr layer was selectively laminated only on the {111} plane of the grain. The mean x/y value of the grains was about 0.27; y was about 0.84 μm, and z 0.05 μm.

The temperature of the emulsion was immediately lowered to 58° C., the pBr value thereof was adjusted to 2.6, and a $Na_2S_2O_3$ solution was added thereto in an amount of $7\times10^{-6}$ mol/mol of AgX and ripened for 20 minutes. A flocculating agent was added to the emulsion, the temperature was lowered to 30° C., and the emulsion was rinsed with water at a pH of 4.0. The emulsion was again dispersed, the pH and pBr thereof were adjusted to 6.4 and 2.6, respectively, and the temperature was elevated to 58° C. The preceding gold sensitizer was added in an amount of $5\times10^{-6}$ mol/mol of AgX and the emulsion was ripened for further 10 minutes. The temperature was lowered to 40° C., and TAI was added in an amount of $2\times10^{-3}$ mol/mol of AgX, and a coating aid was added to the emulsion. The emulsion thus formed was coated on a support film in an amount of 1.5 g/m$^2$ as silver. This sample was designated J2.

COMPARATIVE EXAMPLE

Using the method described in JP-A 2-146033, twin plane-free cubic and tetradecahedral AgBr grains were formed. The mean grain volume of the both grains was same as the mean volume of the grains of Example 1. These were formed under the same conditions as that in Example 1 of JP-A 2-146033 for formation of the nuclei but varying the silver potential to 150 mV and 90 mV for growing the nuclei without forming new nuclei. The emulsion was chemically sensitized under the same condition as Example 1 above and coated on a support film. The sample as coated with the cubic grains was designated sample H1 and that as coated with the tetradecahedral grains was designated sample H2.

Coated samples J1, H1 and H2 were wedgewise exposed for $10^{-2}$ second and developed with MAA-1 developer (as described in the Birch reference above) at 20° C. for 10 minutes. The relative sensitivity of each sample was obtained from the characteristic curve as 120 (J1), 110 (H2) and 100 (H1). From these data, the grains of the present invention were confirmed to have high sensitivity.

Coated samples J1 and J2 were exposed with a blue light for one second, and the number of restrainedly developed nuclei was counted by the method described above to the result that the Y value (the ratio of the density of the chemically-sensitized nuclei on the {111} plane of the grain (number of chemically-sensitized nuclei/cm$^2$) to the density of the chemically-sensitized nuclei on the {100} plane of the grain (number of chemically-sensitized nuclei/cm$^2$) was 4 (J1) and 6 (J2). From these data, the restrained effect of formation of the chemically-sensitized nuclei on the grains of the present invention was confirmed.

EXAMPLE 3

The same process up to addition of the $NH_3$ and $NH_4NO_3$ solutions and ripening of the emulsion for 18 minutes as in Example 1 was repeated. Next, $HNO_3$ (3 N) solution was added to the emulsion, which was adjusted to a pH of 4.0. The temperature was elevated to 60° C., the aqueous Br-2 solution was added to adjust the pBr of the resulting emulsion to 1.7, and the Ag-1 solution and the Br-2 solution were added thereto each at a flow rate of 8 cc/min over a period of 10 minutes using a controlled double jet method. Next, the Ag-2 solution was added, the silver potential was changed to 140 mV, and the Ag-1 solution and the Br-2 solution were added to the emulsion at this potential using a controlled double jet method, which is a linear flow rate accelerating method with an initial flow rate of 8 cc/min and an accelerating flow rate of 0.2 cc/min. The amount of each of the solutions added in this manner was 740 cc. After the addition, the emulsion was stirred for 2 minutes, a flocculating agent was added, the temperature was lowered to 30° C., and the emulsion was washed under the condition using a flocculating water-washing method. Next, the emulsion was again dispersed at 38° C., the pH and pBr values thereof were adjusted to 6.4 and 2.6, respectively. The emulsion grains were sampled and the TEM image of a replica of the grains was observed. From the image, it was found that the mean value of x/y in the deleted parts of the cubic grain was about 0.32, y=0.8 μm and z<0.05μm.

An aqueous solution of Dye (E-1) above was added to the emulsion in an amount of 70% of the saturated adsorption amount, the temperature was elevated to 60° C. and the emulsion was ripened for 10 minutes under these conditions. Next, the temperature was lowered to 55° C., and the emulsion was subjected to the same chemical sensitization as in Example 1. The same antifoggant and coating aid as described in Example 1 were added thereto. The resulting emulsion was coated and dried on a support film. The sample was designated J3. The sample was wedgewise exposed through a minus-blue filter for one second, $10^{-2}$ second and $10^{-4}$ second, and developed with MAA-1 developer at 20° C. for 10 minutes. It was verified that the sample had an excellent high intensity reciprocity law failure characteristic and that it was hardly fogged and had excellent sensitivity/graininess characteristic.

EXAMPLE 4

1000 cc of a dispersion medium solution (containing 20 g of deionized alkali-processed bone gelatin, 12 g of NaCl, 1000 cc of water, and 0.6 g of compound (F-1) as a crystal habit inhibitor) was placed in a reactor and kept at 35° C.

Compound F-1:

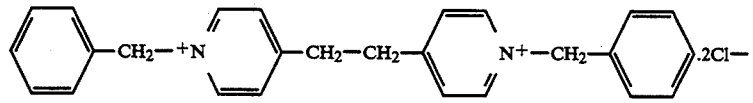

With strong stirring, an Ag-4 solution (containing 10 g of $AgNO_3$ in 200 cc) and a Cl-4 solution (containing 4.5 g of NaCl in 200 cc) were simultaneously added thereto over a period of 2 minutes each in an amount of 200 cc. Next, the temperature of the emulsion was elevated to 55° C. and ripened for 10 minutes. Then, an Ag-5 solution (containing 30 g of $AgNO_3$ in 100 cc) and a Cl-5 solution (containing 14 g of NaCl in 100 cc) were added thereto over a period of 12 minutes each in an amount of 300 cc. A flocculating agent was added to the emulsion, the temperature was lowered to 35° C., the pH was adjusted to 4.0, and the emulsion was washed three times each with water using a flocculating water-washing method. Next, the pH of the emulsion was elevated to 5.5, 10 g of gelatin was added, the volume of the emulsion was adjusted to 1.2 liters, and thus the emulsion was again dispersed at 40° C. About 80% of the crystal habit inhibitor was removed from the emulsion by the washing.

The pCl-of the emulsion was adjusted to 1.1 by addition of NaCl thereto, the temperature thereof was elevated to 55° C., and the Ag-5 solution and the Cl-5 solution were added thereto each at a flow rate of 30 cc/min over a period of 15 minutes using a controlled double jet method at a pCl of 1.1. After the addition, the emulsion was stirred for 2 minutes, then a flocculating agent was added, the temperature was lowered to 35° C., and the emulsion was thus washed three times each with water using a flocculating water-washing method. Next, gelatin was added, the emulsion was again dispersed at 35° C., and the pH and pAg values thereof were adjusted to 6.4 and 7.5, respectively. The TEM image of a replica of the emulsion grains was observed and it was found that the mean value of x/y of the deleted parts of the cubic grains was 0.35, y=0.6 μm and z<0.05 μμm. Color Sensitizing Dye (E-1) was added to the emulsion in an amount of 65% of the saturated adsorption amount. Next, diphenylthiourea and chloroauric acid were added thereto for optimum chemical sensitization of the emulsion. 1-Phenyl-5-mercaptotetrazole was added thereto as an antifoggant. The resulting emulsion was coated on a support film and dried. The sample thus obtained was designated J4. The sample was wedgewise exposed through a blue filter for one second, $10^{-2}$ second and $10^{-4}$ second, and developed with MAA-1' developer (derived from MAA-1 developer by substituting Cl− for Br−) at 20° C. for 5 minutes. The sample was confirmed to have an excellent high intensity reciprocity law failure characteristic.

The emulsion was used as Emulsion A of Sample No. 201 in Example 2 of European Patent 508398A1 with the result that the reciprocity law failure characteristic and the image quality of the modified sample were improved.

The AgX emulsion grains of the present invention are superior to any other conventional grains. Specifically, since the sites of forming chemical-sensitized nuclei are defined, dispersion of the latent images formed is inhibited, and the sensitivity of the emulsion is high. Moreover, the reciprocity law failure characteristic, the developability and the image quality to be formed are excellent.

One preferred embodiment of the present invention is such that a sensitizing dye is adsorbed preferentially on the {100} plane of the grains and that chemically-sensitized nuclei are formed preferentially on the {111} plane of the grains. The embodiment is especially advantageous because of the following points. Almost all (about 90% or more) the illustrated sensitizing dye compounds adsorb selectively on the {100} plane of the grain. Therefore, the selectable range of usable sensitizing dyes is broad. The site to which sensitizing dyes adsorb is separated from the site of forming latent images thereon on the surface of the AgX grain so that the surface function-separating chemically-sensitizing effect as described in JP-A 2-34 is achieved by the use of the AgX grains. In particular, where the {100} plane of the grains is a high-iodide layer, the charging electron zone is elevated so that positive dye holes may easily be injected into the charging electron zone from the standpoint of the energy level. Accordingly, the injected positive holes react with the reduced silver nuclei in the AgX layer to release electrons therefrom to augment the sensitivity of the emulsion. Since the {111} plane of the grain is a low-iodide layer or a chloride-containing layer, the charging electron zone is low. Therefore, the latent images present therein are hardly attacked by positive dye holes and are stable. Where the chemical-sensitized nuclei on the surface of the {111} plane of the grain are made to form shallow latent images, the latent images formed are protected from the external effects and are stabilized, preferably.

While the invention has been described in detail and with reference to specific embodiments thereof, it will be apparent to one skilled in the art that various changes and modifications can be made therein without departing from the spirit and scope thereof.

What is claimed is:

1. A silver halide emulsion comprising a dispersion medium and silver halide grains, wherein (i) the grains of 20% or more of the total projected area of all the silver halide grains have an octahedral shape, wherein said octahedral shape is derived from cubic grains by deleting two apices among the eight apices of the cubic grains, (ii) the outer surface of said silver halide grains having an octahedral shape comprises one triangular {111} plane at each of the deleted sites and said triangular {111} planes are parallel to one another, (iii) the main plane (the maximum flat plane of the outer surface of the grain) is a {100} plane, (iv) the edge length of said cubic grains prior to deleting the two apices is given by (y) and the edge length of the two deleted apices is given by (x), (v) (x/y) is from 0.06 to 0.65, and (vi) the apices other than said two deleted apices are not deleted, or if deleted, have an edge length (z) which satisfies the relationship 2z<x, wherein the silver halide grains each have two or more parallel twin crystal planes in the inside of the grain.

2. The silver halide emulsion as claimed in claim 1, wherein (i) (x/y) is from 0.06 to 0.6, and (ii) the apices other than said two deleted apices are not deleted, or if deleted, have an edge length (z) which satisfies the relationship 3z<x.

3. The silver halide emulsion as claimed in claim 1, wherein said silver halide grains having an octahedral shape account for 50% or more of the total projected area of all the silver halide grains.

4. The silver halide emulsion as claimed in claim 1, wherein the halogen composition of an outer surface layer of the silver halide grains at a {100} plane is substantially different from the halogen composition of an outer surface layer of the silver halide grains at a {111} plane, wherein the outer surface layer is a crystal layer of two to 400 lattices more from the grain surface.

5. The silver halide emulsion as claimed in claim 1, wherein the halogen composition of an outer surface layer of the silver halide grains at a {100} plane is substantially the same as the halogen composition of an outer surface layer of the silver halide grains at a {111} plane, wherein the outer surface layer is a crystal layer of two to 400 lattices or from the grain surface.

6. The silver halide emulsion as claimed in claim 1, wherein the silver halide grains of the silver halide emulsion have a mono-disperse grain size distribution.

7. The silver halide emulsion as claimed in claim 1, wherein said silver halide grains having an octahedral shape are sensitized chemically, and chemically sensitized nuclei are formed preferentially on the outer surface of said grains at a {111} plane.

8. The silver halide emulsion as claimed in claim 1, wherein the proportion of the grains having two parallel twin planes therein is 60% or more.

* * * * *